United States Patent [19]

Liberatore

[11] 4,121,826

[45] Oct. 24, 1978

[54] EXERCISING DEVICE WITH BANK

[76] Inventor: Victor Liberatore, #4 W. Mid Ave., Midland, Pa. 15059

[21] Appl. No.: 742,470

[22] Filed: Nov. 17, 1976

[51] Int. Cl.[2] ..... A63B 21/06

[52] U.S. Cl. ..... 272/117; 272/122; 232/4 R; 273/58 R; 272/123; 272/107; 272/108

[58] Field of Search ..... 272/123, 122, 117, 124; 232/4 R, 12, 55; 193/27; 46/3, 4, 5, 2; 128/272, DIG. 24; 273/63 E, 171, 58 R

[56] References Cited

U.S. PATENT DOCUMENTS

| | | | |
|---|---|---|---|
| 984,721 | 2/1911 | Titus | 272/122 |
| 3,002,313 | 10/1961 | Hutchison | 46/3 |
| 3,143,285 | 8/1964 | Fulton | 46/3 X |
| 3,226,117 | 12/1965 | Walklet | 272/123 |
| 3,231,270 | 1/1966 | Winer | 272/123 |
| 3,243,914 | 4/1966 | Poynter | 46/3 |
| 3,295,247 | 1/1967 | Lerner | 46/4 |
| 3,572,702 | 3/1971 | Dorn | 272/123 |
| 3,749,408 | 7/1973 | Mills | 273/171 |

*Primary Examiner*—Richard J. Johnson
*Assistant Examiner*—William R. Browne

[57] ABSTRACT

A combination weight-type exercising device-savings bank wherein coins can be added to the device as desired to increase the weight of the same. There is an integral, unitary, removable assembly that is press fitted in the opening in the housing that receives the coins. The assembly guides the money through the interior of the housing.

9 Claims, 9 Drawing Figures

EXERCISING DEVICE WITH BANK

BACKGROUND OF THE INVENTION

The prior art is aware of exercising devices of various types, and the same are well documented in Class 272. Included in this Class are patents relating to weight lifting structure and several of these patents in particular deal with the selective addition of weight whereby the user will be able to exercise with increased weight to increase his strength. These patents disclose structure which permits the addition of sand, shot, etc. by the removal and replacement of various cover means which controll access to the interior of the variously shaped exercising devices.

SUMMARY OF THE INVENTION

Accordingly, the present invention provides a novel type of access means to permit the introduction of weight preferable in the form of coins into a weight lifting device. In one embodiment the access means is designed to facilitate the deposition of coins therein and to prevent the removal thereof. This, then, will teach younger children who are engaged in a weight lifting program a sense of saving. As the child becomes proficient at one weight level, the addition of coins will increase the weight thereof to permit him to work at a higher weight level. In another embodiment the closure for the access opening is such that the same can be readily removed but which is securely retained in place but does not interfere with the use of the weight lifting means.

DESCRIPTION OF THE PREFERRED EMBODIMENT

Figure 1:
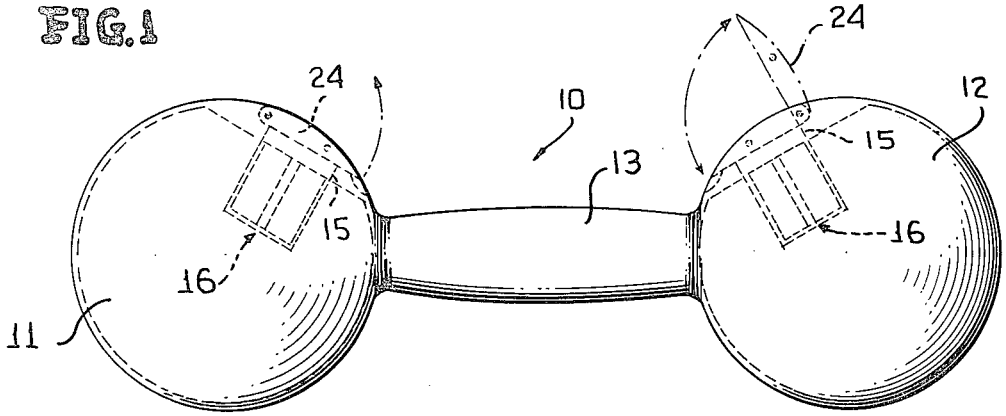
FIG. 1 is a view of a conventially shaped exercising device having the novel weight introduction means associated therewith.

With reference to FIG. 1, a conventionally shaped dumbell is designated generally at 10 and comprises two generally circular hollow housings 11, 12 connected by a bridging member 13 which in use is grasped by the hand of the user for raising and lowering the same while exercising. The dumbell of the present invention, like the prior art, provides recessed access openings 15 in each of the circular housings through which weight in the form of sand, lead shot, etc. can be added or removed to regulate the overall weight of the dumbell. Within each of the access openings 15 are disposed novel weight guiding means 16 which are designed to receive weight in the form of various shaped coins which facilitate the introduction of the coins into the housing 11, 12 but which prevent the easy removal of the same. With such an arrangement it is apparent that younger people seriously engaged in a weight lifting program can be encouraged to save money by the addition of coins to increase the weight as one progresses from one weight level to another.

Figure 2:
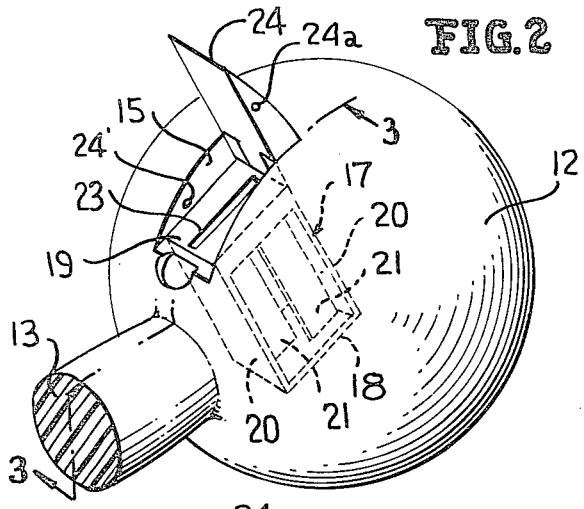
FIG. 2 is an enlarged view showing the details of the weight introduction means.
Figure 5:
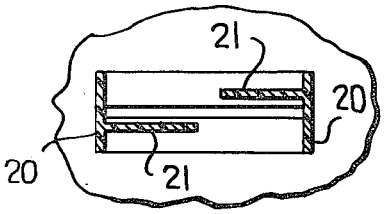
FIGS. 3, 4 and 5 are sectional views taken on the lines 3—3, 4—4, 5—5 of FIGS. 2, 3 and 4 respectively, showing further details of the said means.

As seen in FIG. 2, the coin receiving means 16 is seen to be comprised of a housing 17, which is rectangular in outline and completely fills the opening 15, and includes a base 18, a top 19 and end walls 20, 20 connecting one to the other. As seen, in FIG. 2, and 3 the base 18 is disposed in the interior of the housing 11, 12 and the top 19 is held in place in a thickened portion of the housing 11.

Additionally, offset partition walls 21, 21 extend inwardly from each of the end walls 20, 20 and terminate approximately in the center of the housing 17 and defines a space 22 therebetween for receiving a coin therein from a coin receiving slot 23 provided in the top 19. As is apparent when a coin is placed in the slot 23, the same passes through the space 22 between the walls 21, 21 encounters the partition base 18 and rolls up against either end wall 20, 20 and falls through either of the open sides into the interior of the housings 11, 12.

Figure 3:
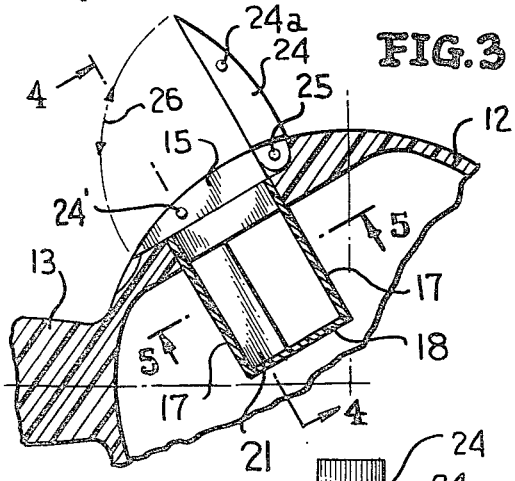
Figure 4:
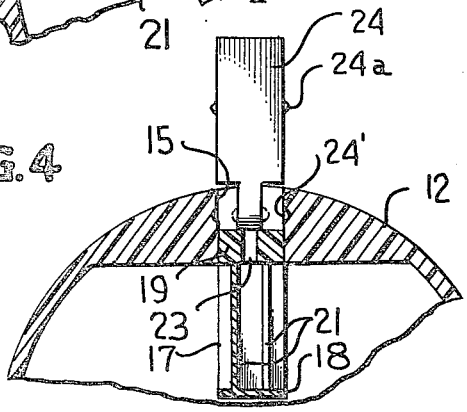

As seen in FIGS. 2, 3 and 4, a cover 24 is pivoted at 25 to the wall of the recess 15 and is shaped to conform thereto to selectively expose and close the same as it is moved in the direction of arrow 26, FIG. 4, to permit the introduction of coins into the slot 16. A fingernail recess 27 is positioned opposite the pivot 25 to facilitate the engagement and movement of the cover 24, and, protuberances **24*a* are provided to lockingly engage recesses 24'** to hold the cover in place.

In using the embodiment shown in FIGS. 1-5, the user inserts a fingernail in the recess 27 and raises the cover 24 to expose the slot 23 and the coins are then inserted therein and deposited in the housing 11, 12 in a manner as explained hereinabove. Thereafter the cover is closed and the dumbell is ready to be used in the normal fashion.

Figure 6:
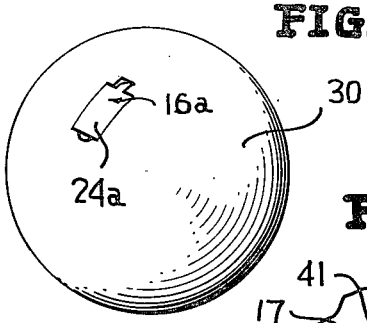
FIG. 6 is a perspective form of another embodiment showing the weight introduction means associated with a shot put.
Figure 7:
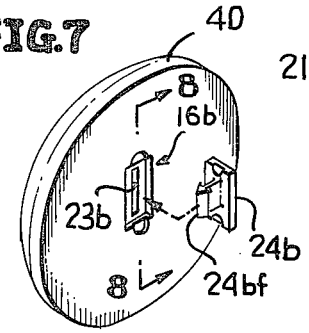
FIG. 7 is a perspective form of another embodiment showing the weight introduction means associated with a discus.

Variations of the embodiment shown in FIGS. 1-5 are depicted in FIGS. 6 and 7. In FIG. 6 the coin receiving means **16*a* is associated with a shot put 30. As before the means 16*a* is providing with a cover 24*a*** and functions in the same manner as previously described.

Figure 8:
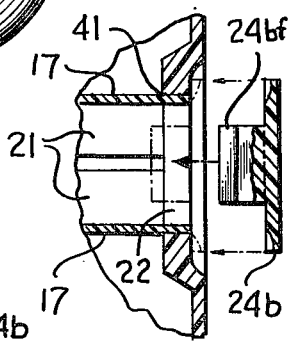
FIG. 8 is a sectional view of the details of the access means taken on line 8—8 of FIG. 7.

In FIG. 7, the coin receiving means **16*b*, which is associated with a discus 40, differs from that previously described at FIGS. 1 through 5 in that the coin receiving slot 23*b* is selectively open and closed by a plug type cover 24*b*. As seen in this Figure and in FIG. 8, the cover 24*b* has a resilient plug section 24*bb* disposed medially thereof with a flange 24*bf* which seats against the wall 41 adjacent the slot 23*b* and is maintained therein. In use, the plug 24*b* is grasped at the fingernail recesses 21*b* and pulled out causing the flange 24*bf* to compress and move outwardly through the slot. After the coins are deposited, the plug 24 is pushed back into the recess and maintained therein by the flange 24*bf*** thereof.

Figure 9:
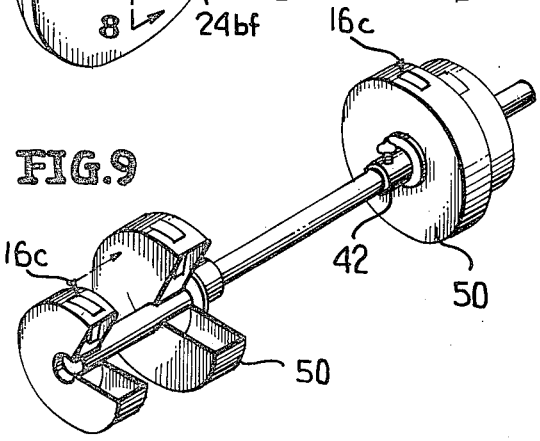
FIG. 9 is a perspective form of another embodiment showing the weight introduction means associated with another type of weight lifting means.

In FIG. 9, the coin receiving **16*c* means are associated with conventionally shaped bar bell weights 50 maintained on a supporting bar 51 by clamp 42** in the normal fashion. The cover means in this embodiment can be either of the pivoted cover or plug type cover variety discussed hereinabove.

The disclosed embodiments can be fabricated from any material desired, e.g. plastic, steel, etc.

What is claimed is:

1. A weight receiving means comprising a hollow housing, a recessed opening provided in said housing, an integral, unitary, removable means press fitted in said recessed opening for guiding material therethrough into the interior of the housing after being placed in said opening, said means including a top wall having an opening therein, a bottom wall and end walls connecting the top wall to the bottom wall, said topwall being flush with the top portion of the recessed opening and closing the same with the bottom wall being disposed within the hollow housing and a side wall extending from each of said end walls and terminating short of the opposite end wall, said side walls being spaced from one another and forming a passageway through which material is guided therein from said top wall opening and into the interior of the housing.

2. The weight receiving means of claim 1 further including a cover, said cover substantially closing said opening recess in closed position and exposing said top wall opening when moved away therefrom.

3. The weight receiving means of claim 2 wherein the cover is pivotally mounted over the recess.

4. The weight receiving means of claim 2 wherein the exterior of the cover is contoured to the shape of the housing to provide a smooth uninterrupted surface.

5. The weight receiving means of claim 1 wherein the hollow housing is a shotput.

6. The weight receiving means of claim 1 wherein the hollow housing is a discus.

7. The weight receiving means of claim 1 wherein the material guiding means is pressed fit into the opening.

8. The weight receiving means of claim 1 wherein the hollow housing is one of the spheres of a bar bell.

9. The weight receiving means of claim 2 wherein the hollow housing is one of the discs of a bar bell.

* * * * *